United States Patent [19]

Reed

[11] Patent Number: 5,003,607

[45] Date of Patent: Mar. 26, 1991

[54] HEARING AID WITH AUDIBLE CONTROL FOR VOLUME ADJUSTMENT

[76] Inventor: James S. Reed, 3314 Woodrail Ter., Columbia, Mo. 65203

[21] Appl. No.: 338,376

[22] Filed: Apr. 12, 1989

Related U.S. Application Data

[63] Continuation of Ser. No. 57,337, Jun. 3, 1987, abandoned.

[51] Int. Cl.[5] ..... H04R 25/02

[52] U.S. Cl. ..... 381/68.4; 381/68.6; 379/109

[58] Field of Search ..... 381/68.4, 69, 69.1–69.2, 381/68.6, 104, 68, 60, 109; 338/163, 174; 200/291, 308, 11 TW; 128/746

[56] References Cited

U.S. PATENT DOCUMENTS

| | | | |
|---|---|---|---|
| 1,356,634 | 10/1920 | Koch | 381/68.4 |
| 1,826,797 | 10/1931 | Leach et al. | 381/69.2 |
| 2,451,241 | 10/1948 | Rosentreter | 338/163 |
| 3,632,830 | 3/1953 | Aust et al. | 338/174 |
| 3,665,127 | 5/1972 | Lockard et al. | 200/11 TW |
| 3,699,453 | 10/1972 | Berenbaum | 381/104 |
| 3,900,816 | 8/1975 | Kiyono | 338/116 |
| 4,114,132 | 9/1978 | De Rouen et al. | 338/174 |
| 4,257,324 | 3/1981 | Stefansson et al. | 101/110 |
| 4,367,739 | 1/1983 | Le Veen et al. | 604/224 |
| 4,375,016 | 2/1983 | Harada | 381/153 |
| 4,498,904 | 2/1985 | Turner et al. | 604/211 |
| 4,532,649 | 7/1985 | Bellafiore | 381/68.4 |
| 4,571,571 | 2/1986 | Onodera | 338/174 |
| 4,697,441 | 10/1987 | Allen | 70/16 |
| 4,698,613 | 10/1987 | Okuya | 200/16 C |

FOREIGN PATENT DOCUMENTS

| | | | |
|---|---|---|---|
| 641620 | 2/1984 | Switzerland | 381/68 |

OTHER PUBLICATIONS

*Hearing Instruments*, Richards/Omni Hearing Systems Ad, vol. 37, No. 11, Nov. 1986, p. 61.

*Primary Examiner*—James L. Dwyer
*Attorney, Agent, or Firm*—Gravely, Lieder & Woodruff

[57] ABSTRACT

An in the ear hearing aid where the volume is reset to predetermined level after inserting into the ear of the user by counting a predetermined number of clicks from high or low volume. The clicks are produced by a pawl engaging serrations on the peripheral edge of the volume control.

3 Claims, 1 Drawing Sheet

FIG. 1
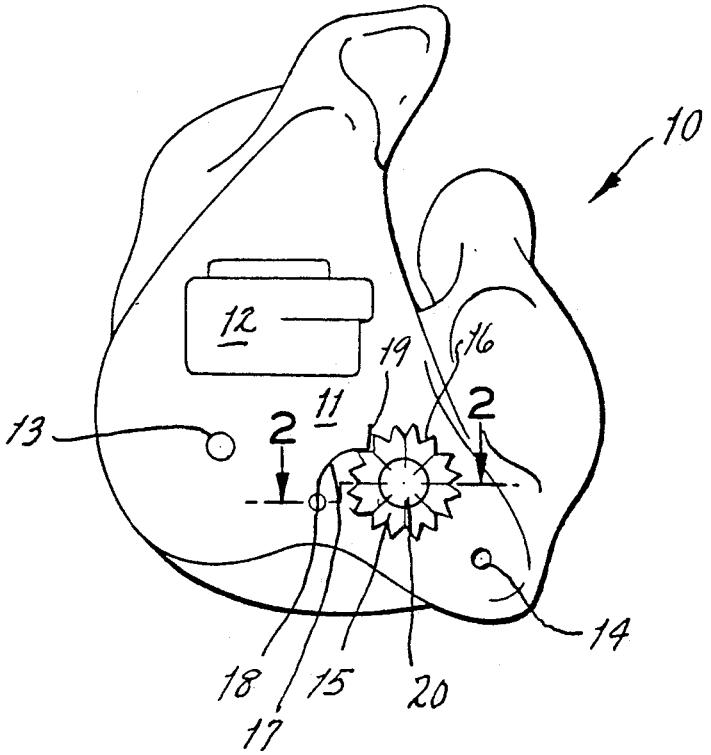
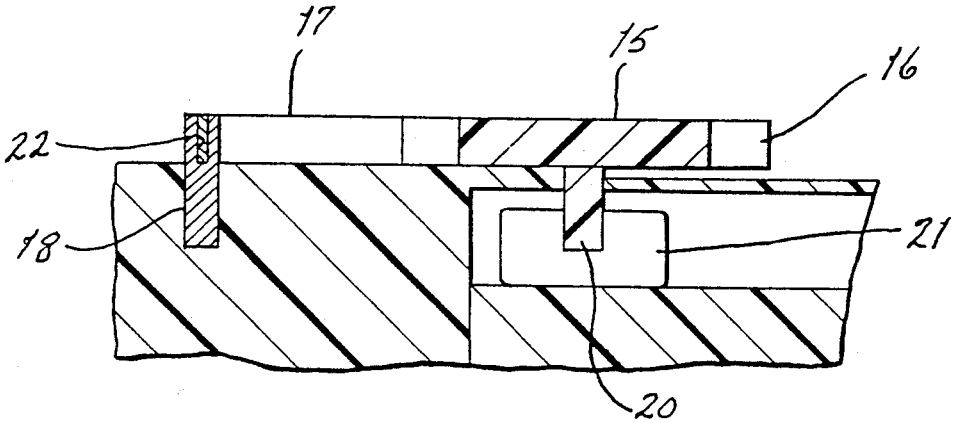
FIG. 2

HEARING AID WITH AUDIBLE CONTROL FOR VOLUME ADJUSTMENT

This is a continuation of co-pending application Ser. No. 07/057,337 filed on June 3, 1987 now abandoned.

BACKGROUND OF THE INVENTION

This invention relates to the field of hearing aids, and more particularly to "In The Ear" type hearing aids. The invention relates specifically to the use of audible sound to quickly and accurately adjust the volume control after inserting the aid in the ear.

A type of in the ear hearing aid is shown in Harada U. S. Pat. No. 4,375,016. Another form of an in the ear aid is illustrated in Bellafiore U. S. Pat. No. 4,532,649.

The advent of the in the ear hearing aid has revolutionized the hearing aid industry. The ease, convenience and simplicity of these aids removes much of the reluctance of the public to wear them. They can very quickly and easily be inserted into and removed from the ear. The one big inconvenience with all types of in the ear hearing aids is that it is very difficult to perform this action without touching the volume control knob, thereby changing the setting. This necessitates a period of time, sometimes an extended period, of adjusting the volume control after the aid is positioned in the ear to reset the proper level setting for maximum benefit at a good comfort level.

Accordingly, it is a principal object of this invention to provide a device suitable for use with all in the ear hearing aids which utilizes audible sound to quickly and accurately adjust the volume to a predetermined level after the aid is inserted in the ear.

Another object is to eliminate the necessity for the wearer to raise and lower the volume control for a period of time after the aid has been inserted in the ear.

Still another object is to provide a device in which the volume control knob is audibly adjusted from either the "off" or "maximum" positions to the desired adjustment promptly after the aid is inserted in the ear.

These and other objects and advantages will become apparent hereinafter.

The present invention comprises an in the ear hearing aid having a volume control knob which clicks audibly as it is turned whereby the user can set the volume to a predetermined level after the aid is inserted in the ear by advancing the knob a known number of clicks from the off position or retreating the knob a known number of clicks from the maximum volume position.

The invention also consists in the parts and in the arrangements and combinations of parts hereinafter described and claimed.

In the accompanying drawings which form part of the specification and wherein like numerals and letters refer to like parts wherever they occur:

FIG. 1 is a plan view of an in the ear hearing aid; and

FIG. 2 is a fragmentary sectional view taken along line 2—2 of FIG. 1.

DETAILED DESCRIPTION

An in the ear hearing aid 10 of any conventional type is shown in FIG. 1. The hearing aid 10 comprises a body portion 11 which includes a battery compartment 12, a microphone 13, a vent opening 14, and a volume control knob 15. The volume control knob 15 is mounted on a shaft 20 connected to an amplifier 21 and is of special construction which includes serrations 16 on the outer circumferential edge.

A spring steel pawl 17 is mounted in a slot 22 on a pin 18 fixed to the body 11 and includes a free end 19 which engages the serrations 16 so that a distinct audible "click" is heard as the knob is rotated.

Thus, in use, the volume control knob is moved to one end of its volume range, either high or low, and then rotated away from that location a predetermined number of clicks so that the volume is set at the desired predetermined level. This is done when the aid is inserted into the ear and avoids the problem of adjusting the volume by trial and error every time the aid is removed and inserted into the ear. The selected level is previously determined when the aid is in use. Then after it is located by counting the number of clicks to high or low volume, the sound can be returned each time to the selected level by moving the volume knob the necessary number of clicks.

Instead of having the pawl 17 and serrations 16 on the outside of the hearing aid, they can be inside the aid. The serrations 16 also can be on a boss beneath the knob 15 or even on the shaft 20 on which the knob 15 is mounted. These alternative constructions are within the scope of this invention and may be used depending on the overall design of the hearing aid.

This invention is intended to cover all changes and modifications of the example of the invention herein chosen for purposes of the disclosure which do not constitute departures from the spirit and scope of the invention.

What is claimed is:

1. An in the ear hearing aid comprising a body sized to fit wholly within a user's ear and having a portion facing outwardly of the user's ear, a microphone mounted on said portion for picking up sound, a volume control rotatably mounted on said portion in spaced relation to said microphone and accessible to the user, when the hearing aid is inserted, for rotational movement between high volume and low volume extreme positions, and means associated with the volume control to produce distinct separate audible clicks as the volume control is moved incrementally from high to low volume extreme positions so that the user is aided in hearing the separate audible clicks when the hearing aid is inserted.

2. An in the ear hearing aid comprising a body sized to fit wholly within a user's ear and having a portion facing outwardly of the user's ear, a microphone mounted on said portion for picking up sound, a rotatable volume control knob on said portion and accessible to the user, when the hearing aid is inserted, for rotational movement between high volume and low volume extreme positions, and means associated with the volume control knob to produce distinct separate clicks made audible to the user through said hearing aid while inserted in the user's ear as the volume control is moved incrementally from high to low volume positions, the volume control knob being provided with peripheral serrations and said means comprising a pawl urged into the serrations for producing the audible clicks as the volume control knob is moved from high to low volume extreme positions.

3. The hearing aid of claim 2 wherein the serrations are on the circumferential edge of the volume control knob and the pawl is of spring steel having one end fixed in a pin on the body of the hearing aid and having a free end urged against the serrated edge of the knob.

* * * * *